United States Patent [19]

Krasser

[11] 4,166,993

[45] Sep. 4, 1979

[54] PUSH BUTTON ACTUATED BIMETAL CONTROLLED EXCESS CURRENT SWITCH

[75] Inventor: Fritz Krasser, Altdorf, Fed. Rep. of Germany

[73] Assignee: Ellenberger & Poensgen GmbH, Altdorf, Fed. Rep. of Germany

[21] Appl. No.: 875,805

[22] Filed: Feb. 7, 1978

[30] Foreign Application Priority Data

Feb. 15, 1977 [DE] Fed. Rep. of Germany ... 7704459[U]

[51] Int. Cl.[2] ..... H01H 71/16

[52] U.S. Cl. ..... 337/66; 335/45; 337/64; 337/75

[58] Field of Search ..... 337/66, 64, 62, 70, 337/71, 72, 74, 75; 335/45

[56] References Cited

U.S. PATENT DOCUMENTS

| | | | |
|---|---|---|---|
| 2,952,757 | 9/1960 | Ellenberger | 337/66 |
| 3,991,395 | 11/1976 | Aust et al. | 337/66 |
| 4,044,325 | 8/1977 | Krasser | 337/66 |
| 4,091,351 | 5/1978 | Flory et al. | 337/66 X |

*Primary Examiner*—R. L. Moses
*Attorney, Agent, or Firm*—Spencer & Kaye

[57] ABSTRACT

In a push button actuated, bimetal controlled, current overload switch capable of undergoing trip-free release and including a bimetal strip disposed in a housing, an angular contact bridge disposed in the housing and forming part of the current path provided by the switch, a switching rod mounted in the housing for axial movement relative thereto and having one end extending out of the housing, a switching rod extension mounted at the other end of the rod and within the housing and arranged to bear against the bridge, and a spring disposed to maintain a spring force between the bridge and the extension, opening of the switch by actuation of the rod is made possible by the provision of an obliquely extending lever disposed in the housing, having one end pivotally secured to the housing, having its other end engaging the bimetal strip, and located in the path of travel of the extension during axial movement of the rod into the housing for enabling such movement of the rod to displace the lever in a direction to change the switch from a switched-on state to a switched-off state.

3 Claims, 3 Drawing Figures

PUSH BUTTON ACTUATED BIMETAL CONTROLLED EXCESS CURRENT SWITCH

BACKGROUND OF THE INVENTION

The present invention relates to a push button actuated bimetal controlled excess current switch with trip-free release, in whose housing an angular contact bridge is pivotally mounted and having an outwardly directed switching rod provided with an extension which contacts the underside of the contact bridge under spring pressure.

Such excess current switches are known, for example, from German Pat. No. 1,051,951. The switch disclosed there has, in addition to a thermal release by means of a bimetal strip, an additional electromagnetic release. The structural principle of switches of the type disclosed in that patent can also be applied to switches which are controlled only by a bimetallic member.

The prior art switches can be manually reclosed after a thermal and/or electromagnetic release by pressing an outwardly directed push button in against the force of a spring. In the interior of the switch, the push button is connected with a rod on which an angular contact bridge is pivotally mounted and which, when the push button is depressed, is pivoted back to its switched-on position. If the switch is to be actuated manually, a second push button must be actuated which bends the bimetal strip and and thus moves a detent which has held the angular contact strip.

SUMMARY OF THE INVENTION

It is an object of the present invention to enable only a single outwardly directed push button to control the operation of such an excess current switch so as to permit it to be switched on and off according to the principle of a push-push actuation.

This and other objects are accomplished according to the present invention by the provision of an obliquely oriented lever disposed in the stroke range of the extension attached to the switching rod, with the one end of the lever resting against the bimetal strip.

The lever may here be preferably shaped so that its end grips the bimetal strip in the manner of a vise and, consequently, not only will actuation of the switching rod be effective to bend this strip, but the switching rod will in turn be carried along by the bimetal strip if the latter is heated and consequently deformed.

The extension connected to the switching rod is preferably provided with a slide tongue which abuts against the lever when the switching rod is actuated. Furthermore, the extension is provided in a known manner with an abutment which is disposed in the region of a protrusion molded onto the contact bridge and which is provided for the purpose of moving the contact bridge downward upon actuation of the switching rod if the switch is switched off, to thus return the contact bridge to the switched-on position.

Finally, the extension is provided, in a likewise known manner, with a pressure finger which in the switched-on state rests against the underside of the contact bridge under spring pressure and thus produces the required contact pressure.

DESCRIPTION OF THE PREFERRED EMBODIMENTS

Figure 1:
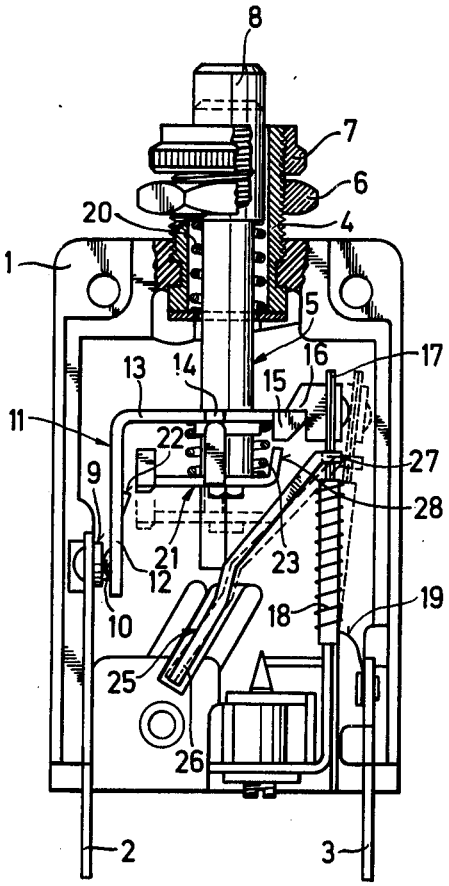
FIG. 1 is a top view partly in cross section, of a preferred embodiment of a switch according to the invention, with its top cover removed and with the switch on, or closed.
Figure 2:
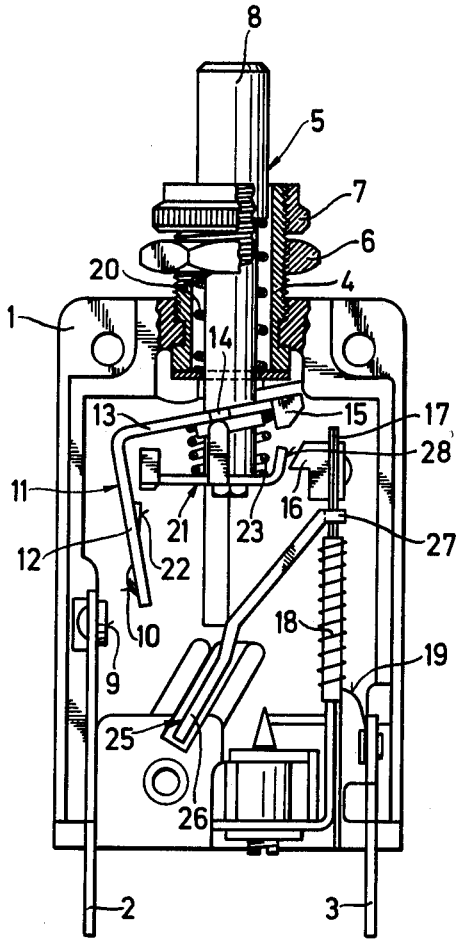
FIG. 2 is a view similar to that of FIG. 1 showing the switch in its switched-off, or open, state.
Figure 3:
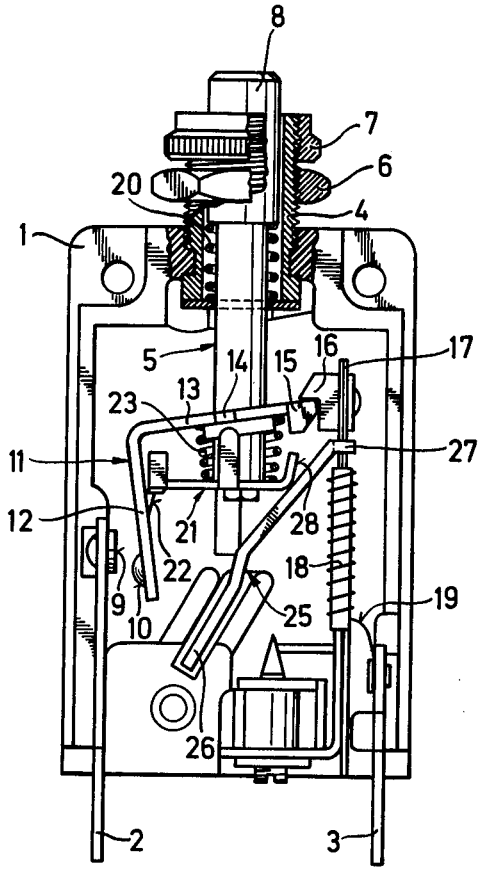
FIG. 3 is a view similar to that of FIG. 1 showing the switch at about the midpoint in its movement from its open state of FIG. 2 to its closed state of FIG. 2.

The embodiment shown in FIGS. 1, 2 and 3 constitutes a switch mounted in a housing 1 which is made in a known manner of plastic, in particular a duroplastic synthetic. Two connecting terminals, or posts, 2 and 3 and a passage sleeve 4 for a switching rod 5 are mounted in housing 1, the passage sleeve simultaneously carrying fastening nuts 6 and 7. The switching rod 5 is brought to the outside of the housing through sleeve 4 and terminates at the outside with an actuating button 8.

The end of the connecting post 2 which extends into housing 1 is provided with a contact piece 9. In the switched-on state of the switch, a further contact piece 10 rests against this contact piece 9, piece 10 being fastened to an angular contact bridge 11. The angular contact bridge 11 has two arms 12 and 13 and in the illustrated embodiment it is displaceably mounted in housing 1 to be pivotal about tabs, or fingers 14, projecting laterally from arm 13. The arm 13 of contact bridge 11 encloses the switching rod 5, the opening in arm 13 being large enough that the pivotal movement of the contact bridge is not interfered with by rod 5.

The free end of arm 13 carries a contact piece 15 which engages under a hook-shaped contact tongue 16 that is disposed at the free end of a bimetal strip 17. The contact tongue 16 is in electrically conductive connection with the heating conductor 18 of the bimetal strip and the other end 19 of the heating conductor is connected to the outwardly directed connecting terminal 3.

In the switched-on state, which is shown in FIG. 1, current can thus flow only through the connecting terminal 2, the contact pieces 9 and 10, the contact bridge 11, the contact piece 15, the contact tongue 16, the heating conductor 18 and connecting terminal 3.

If the current exceeds a given desired value, the bimetal strip 17 will bend due to being heated to the extent that it takes on the position shown in broken lines in FIG. 1. As a result, the contact tongue 16 escapes toward the right and releases contact piece 15. This in turn causes the contact bridge 11 together with the switching rod 5 and the parts fastened thereto, to be lifted upwardly by the force exerted by a spring 20 surrounding rod 5 and compressed between an abutment fixed to the housing 1 and a shoulder on button 8. This separates contacts 9 and 10 as well as 15 and 16 and the flow of current is therefore interrupted. Consequently the switch is switched off and shortly thereafter bimetal 17 returns to its initial state, as shown in FIG. 2.

To switch the switch back on again, the actuating button 8 and the switching rod 5 are pressed downwardly. An extension 21 secured to rod 5 also moves downwardly, during which movement the extension 21 abuts against a ledge 22 protruding from arm 12 of contact bridge 11 and carries it along in a downward direction. As the downward movement of the contact bridge 11 continues, contact piece 15 comes against contact tongue 16 so that the latter, by the interaction between the obliquely oriented faces of parts 15 and 16, is pressed to the right and bends the bimetal strip 17. The contact piece 15 can then continue to slide past tongue 16 and finally the contact tongue 16 snaps back and holds contact piece 15. As a result of this, the contact bridge 11 has partly returned to its original, switched-on, position and takes on the position shown in FIG. 3. Under the influence of a spring 23, it is then further returned to its original position until, finally, button 8 is released and contact piece 9 again comes to rest against the contact piece 10 and the switched-on position shown in FIG. 1 has been restored.

In order to manually actuate the switch according to the push-push principle, the switch according to the invention is provided with an obliquely extending lever 25 in the region of the travel path of extension 21, the one end 26 of this lever 25 being pivotally mounted in housing 1 and its other end 27 resting against the bimetal strip 17. Preferably, lever 25 is designed so that its one end 27 is clamped around the bimetal strip. This has the advantage that the lever is mounted permanently between the bearing points at its opposite ends and is carried along by the bimetal strip even when the latter is bent by thermal effects.

The extension 21 which is disposed at the lower end of the switching rod 5 includes, inter alia, a slide tongue 28 which upon depression of switching rod 5 abuts against lever 25 and presses it in the direction toward the bimetal strip.

If the switch is initially in the state shown in FIG. 1 and is to be switched off manually, the extension 21 is moved downwardly by pressure on button 8. The slide tongue 28 then abuts against lever 25 and pushes it aside, thus bending the bimetal strip toward the right. As a result the contact tongue 16 escapes towards the right and releases contact piece 15. The angular contact bridge 11 can now slide upwardly and can take on the position shown in dashed lines in FIG. 2. Then release and renewed depression of button 8 will return the switch to its closed state in the manner described above with reference to FIG. 3.

During return of the switch from its open state to its closed state, if rod 5 should be pushed down so far that extension 21 pushes contact tongue 16 away from contact piece 15, this will not interfere with proper operation since engagement between extension 21 and ledge 22 assures that piece 15 will remain below tongue 16 until the latter has returned to its latching position.

The switch structure according to the invention is considerably simpler than that of prior art switches of this type since the additional push button for manual switch-off is eliminated. The switch is therefore easier to produce and can be manufactured, in particular, with smaller dimensions.

Due to the action of spring 23, the switch can also undergo a trip-free release, i.e. a dependable actuation of the switch even in the case where the push button 8 is being held down or the switching rod 5 is jammed. If in such a case there is an excess current, the bimetal strip bends and moves the contact tongue 16 toward the right until contact piece 15 is released and the angular contact bridge 11 is lifted by spring 23. This actuates the contact without movement of switching rod 5, which constitues a trip-free release.

It will be understood that the above description of the present invention is susceptible to various modifications, changes and adaptations, and the same are intended to be comprehended within the meaning and range of equivalents of the appended claims.

What is claimed is:

1. In a push button actuated, bimetal controlled, current overload switch capable of undergoing trip-free release and including a housing, a bimetal strip disposed in the housing, an angular contact bridge disposed in the housing and forming part of the current path provided by the switch, means pivotally and displaceably mounting the bridge in the housing, that means including a switching rod mounted in the housing for axial movement relative thereto and having one end extending out of the housing, a switching rod extension mounted at the other end of the rod and within the housing and arranged to bear against the bridge, and spring means disposed to maintain a spring force between the bridge and the extension, the improvement comprising an obliquely extending lever disposed in said housing, having one end pivotally secured to said housing, having its other end engaging said bimetal strip, and located in the path of travel of said extension during axial movement of said rod into said housing for enabling such movement of said rod to displace said lever in a direction to change said switch from a switched-on state to a switched-off state.

2. An arrangement as defined in claim 1 wherein said other end of said lever is clamped around said bimetal strip to form a permanent connection therewith.

3. An arrangement as defined in claim 1 wherein said extension is provided with a slide tongue via which said extension presses against said lever during axial movement of said rod into said housing.

* * * * *